US012662339B2

(12) United States Patent
Yokoyama et al.

(10) Patent No.: US 12,662,339 B2
(45) Date of Patent: Jun. 23, 2026

(54) CARD CONVEYANCE UNIT

(71) Applicant: NIDEC INSTRUMENTS CORPORATION, Nagano (JP)

(72) Inventors: Satoshi Yokoyama, Nagano (JP); Ryo Uchiyama, Nagano (JP)

(73) Assignee: NIDEC INSTRUMENTS CORPORATION, Nagano (JP)

( * ) Notice: Subject to any disclaimer, the term of this patent is extended or adjusted under 35 U.S.C. 154(b) by 268 days.

(21) Appl. No.: 18/305,385

(22) Filed: Apr. 24, 2023

(65) Prior Publication Data

US 2023/0348213 A1 Nov. 2, 2023

(30) Foreign Application Priority Data

Apr. 28, 2022 (JP) ..... 2022-074477

(51) Int. Cl.
*B65H 1/04* (2006.01)
*B65H 3/06* (2006.01)
*B65H 43/08* (2006.01)

(52) U.S. Cl.
CPC ..... *B65H 1/04* (2013.01); *B65H 3/06* (2013.01); *B65H 43/08* (2013.01); *B65H 2515/60* (2013.01); *B65H 2701/1914* (2013.01)

(58) Field of Classification Search
CPC ..... B65H 5/04; B65H 2405/331; G06K 13/07
See application file for complete search history.

(56) References Cited

U.S. PATENT DOCUMENTS 7,635,122 B2 12/2009 Ohta et al.
8,002,260 B2 8/2011 Ohta et al.
8,550,294 B2 * 10/2013 Martin ..... G06Q 20/18 221/124
12,242,907 B2 * 3/2025 Yokoyama ..... G06K 7/10316

FOREIGN PATENT DOCUMENTS

JP 2007041635 2/2007

* cited by examiner

*Primary Examiner* — Howard J Sanders
(74) *Attorney, Agent, or Firm* — JCIPRNET

(57) ABSTRACT

A card conveyance unit having a plurality of card cassettes, a carriage for a card, a carriage conveyance passage extended along a plurality of the card cassettes, a code reader for reading a code indicated on the card, and a control part for controlling a card send-out mechanism, a carriage moving mechanism, a conveying mechanism in the carriage and the code reader. The control part drives the carriage moving mechanism to arrange the carriage at a card taking-in position, drives the card send-out mechanism and the conveying mechanism to take a card into the carriage from a card cassette, drives the carriage moving mechanism to move the carriage to a reading position for the code of the card held by the carriage and controls the code reader to perform a reading operation of the code, and drives the conveying mechanism to send out the card and issued.

4 Claims, 10 Drawing Sheets

CARD CONVEYANCE UNIT

CROSS REFERENCE TO RELATED APPLICATION

The present invention claims priority under 35 U.S.C. § 119 to Japanese Application No. 2022-074477 filed Apr. 28, 2022, the entire content of which is incorporated herein by reference.

TECHNICAL FIELD

At least an embodiment of the present invention may relate to a card conveyance unit for conveying a card on which a code such as a bar code is printed.

BACKGROUND

A card issuing device structured to issue a card on which magnetic information is recorded is described in Japanese Patent Laid-Open No. 2007-41635 (Patent Literature 1). The card issuing device described in Patent Literature 1 includes a card storage part having a plurality of card cassettes in which cards are stored, a card processing part in which reading and writing processing of magnetic information is performed on a card, and a card conveyance part in which a card sent out from each of the card cassettes is conveyed to the card processing part. The card storage part, the card conveyance part and the card processing part are arranged in this order in a direction (orthogonal direction) perpendicular to an arrangement direction of a plurality of the card cassettes.

The card storage part includes a card send-out mechanism structured to send out a card one by one from each of the card cassettes toward the card conveyance part. The card conveyance part includes a carriage and a card conveyance mechanism which moves the carriage in the arrangement direction. The carriage includes a conveyance part which is structured to take a card sent out from the card cassette and hold it in the carriage and send the card from the carriage to the card processing part.

When a card is to be issued, the card issuing device first drives the card conveyance mechanism to move the carriage to a position facing a predetermined card cassette. Further, the card issuing device drives the card send-out mechanism to send out a card from a predetermined card cassette in the orthogonal direction, and the card issuing device drives the conveyance part to take the card sent from the card cassette into the carriage. After that, the card issuing device drives the card conveyance mechanism to move the carriage to a position facing the card processing part. Then, the card issuing device drives a drive part to send the card from the carriage into the card processing part. The card processing part reads magnetic information recorded on the card by a card reader and records necessary information to the card. After that, the card issuing device ejects (issues) the card from the card processing part.

When a card printed with a bar code on its front face is to be issued as a member card or the like, in some cases, the bar code is read at the time of issuing of the card and the information of the bar code having been read is associated with a member information of an owner of the card.

In a case that a function for reading a bar code is added to the card issuing device described in Patent Literature 1, it is conceivable that a bar code reading part including a bar code reader is installed between the card conveyance part and the card processing part. Further, in this case, it is conceivable that, in the card issuing device, a card taken into the carriage from the card cassette is sent into the bar code reading part from the carriage, and a reading operation for a bar code is performed in the bar code reading part and, after that, the card is sent into the card processing part from the bar code reading part. However, when such a structure is adopted, a size of the card issuing device is increased in the orthogonal direction by providing the bar code reading part. Further, another send-out mechanism for sending out a card is required between the bar code reading part and the card processing part.

SUMMARY

At least an embodiment of the present invention may advantageously provide a card conveyance unit whose size is prevented or restrained from being enlarged in a direction perpendicular to an arrangement direction of card cassettes in a case that a code reader for reading a code indicated on the card is provided.

According to at least an embodiment of the present invention, there may be provided a card conveyance unit which includes, in a case that three directions perpendicular to each other are defined as an "X" direction, a "Y" direction and a "Z" direction, a plurality of card cassettes which are arranged in the "Y" direction, a carriage, a carriage conveyance passage which is extended in the "Y" direction on one side in the "X" direction with respect to the plurality of the card cassettes, a carriage moving mechanism which moves the carriage along the carriage conveyance passage, a card send-out mechanism which sends out cards laminated and stored in each of the card cassettes one by one to the one side in the "X" direction toward the carriage conveyance passage, a conveying mechanism which is provided in the carriage to take in and hold the card sent out from the card cassette on the carriage and send out the card in the "X" direction from the carriage, a code reader which reads a code indicated on a surface of the card, and a control part which drives and controls the card send-out mechanism, the carriage moving mechanism, the conveying mechanism and the code reader. The carriage conveyance passage is set with a plurality of taking-in positions on the one side in the "X" direction with respect to the card cassettes where the card sent out from each of the card cassettes is taken into the carriage, a reading position where the code of the card held by the carriage is read, and a sending-out position where the card is sent out from the carriage to the one side in the "X" direction. The code reader faces the card which is held by the carriage in the "Z" direction at the reading position. The control part is configured so that the control part drives and controls the carriage moving mechanism to arrange the carriage at one of the plurality of the taking-in positions and then, the control part drives and controls the card send-out mechanism and the conveying mechanism to take the card into the carriage from the card cassette disposed on the other side in the "X" direction with respect to the carriage, next, the control part drives and controls the carriage moving mechanism to move the carriage to the reading position, and the control part drives and controls the code reader to perform a reading operation for reading the code, after that, the control part drives and controls the carriage moving mechanism to arrange the carriage at the sending-out position and, after that, the control part drives and controls the conveying mechanism to send out the card to the one side in the "X" direction.

According to at least an embodiment of the present invention, the code reader faces a card held by the carriage in the "Z" direction and reads a code at a reading position set in the carriage conveyance passage. Therefore, the card cassette, the carriage conveyance passage and the code reader are avoided being arranged in this order in the "X" direction which is perpendicular to an arrangement direction of a plurality of the card cassettes. Therefore, the card conveyance unit is prevented or restrained from being enlarged in the "X" direction. Further, in a structure that the card cassette, the carriage conveyance passage and the code reader are arranged in this order, another send-out mechanism is required for sending out the card on which a reading operation has been performed by the code reader to the one side in the "X" direction. However, when the reading position by the code reader is provided on the carriage conveyance passage, the card in which a reading operation by the code reader has finished can be sent out to the one side in the "X" direction by the conveying mechanism provided in the carriage.

In this embodiment, it may be configured that the control part acquires a result whether reading of the code has been normally performed by the reading operation or not and, in a case that the code has not been read, the control part drives and controls the conveying mechanism to move the card in the "X" direction on the carriage and perform the reading operation again. In other words, in a case that the code reader is unable to read a code in the reading operation, a card taken into the carriage may be set in a state that the card is not held at an appropriate position on the carriage. In this embodiment, the conveying mechanism is capable of moving the card in the "X" direction on the carriage. Therefore, in a case that the code reader is unable to read a code, when the conveying mechanism is driven and controlled to move the card on the carriage, the code may be read by the code reader.

In this embodiment, it may be structured that the reading position and the sending-out position are the same as each other. According to this structure, after the reading operation has finished, the card is arranged at the sending-out position. Therefore, after the reading operation has finished, the card can be sent out to the one side in the "X" direction without moving the carriage.

In this embodiment, it may be structured that one of the plurality of the taking-in positions, the reading position and the sending-out position are the same as each other. According to this structure, when a card is to be sent out from the card cassette located on the other side in the "X" direction with respect to the taking-in position, which is set at the same position as the reading position and the sending-out position, reading of a code and sending-out to the one side in the "X" direction of the card can be performed without moving the carriage from the taking-in position.

In this embodiment, the code may be one-dimensional code or two-dimensional code. In other words, a code may be a bar code or a QR code (registered trademark).

In this embodiment, it may be structured that the carriage conveyance passage is set with a collecting position for collecting the card from the carriage, the control part acquires a result whether the code reader has read the code by the reading operation or not and, in a case that the code has not been read, the control part drives and controls the carriage moving mechanism to arrange the carriage at the collecting position and drives and controls the conveying mechanism to send out the card to the other side in the "X" direction from the carriage. According to this structure, for example, a card which is unable to read a code by the code reader can be ejected to the other side in the "X" direction from the carriage and collected.

Effects of the Invention

According to this embodiment, the code reader faces a card held by the carriage in the "Z" direction and reads a code at a reading position set in the carriage conveyance passage. Therefore, the card cassette, the carriage conveyance passage and the code reader are avoided being arranged in this order in the "X" direction. Accordingly, a size of the card conveyance unit is prevented or restrained from increasing in the "X" direction. Further, the reading position by the code reader is provided on the carriage conveyance passage and thus, the card having finished a reading operation by the code reader can be sent out to the one side in the "X" direction by the conveying mechanism provided in the carriage.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

A card issuing device which is an embodiment of a card conveyance unit in accordance with the present invention will be described below with reference to the accompanying drawings. In the following descriptions, three directions perpendicular to each other are defined as an "X" direction, a "Y" direction and a "Z" direction. Further, one side in the "X" direction is referred to as an "X1" direction side and the other side is referred to as an "X2" direction side. One side in the "Y" direction is referred to as a "Y1" direction side and the other side is referred to as a "Y2" direction side. One side in the "Z" direction is referred to as a "Z1" direction side and the other side is referred to as a "Z2" direction side. The "X" direction is a front and rear direction in a card issuing device. The "X1" direction side is a front side, and the "X2" direction side is a rear side. The "Y" direction is a width direction in the card issuing device. The "Y1" direction side is one side in a width direction. The "Y2" direction side is the other side in the width direction. The "Z" direction is an upper and lower direction in the card issuing device. The "Z1" direction side is a lower side, and the "Z2" direction side is an upper side.

(Entire Structure)

Figure 1:
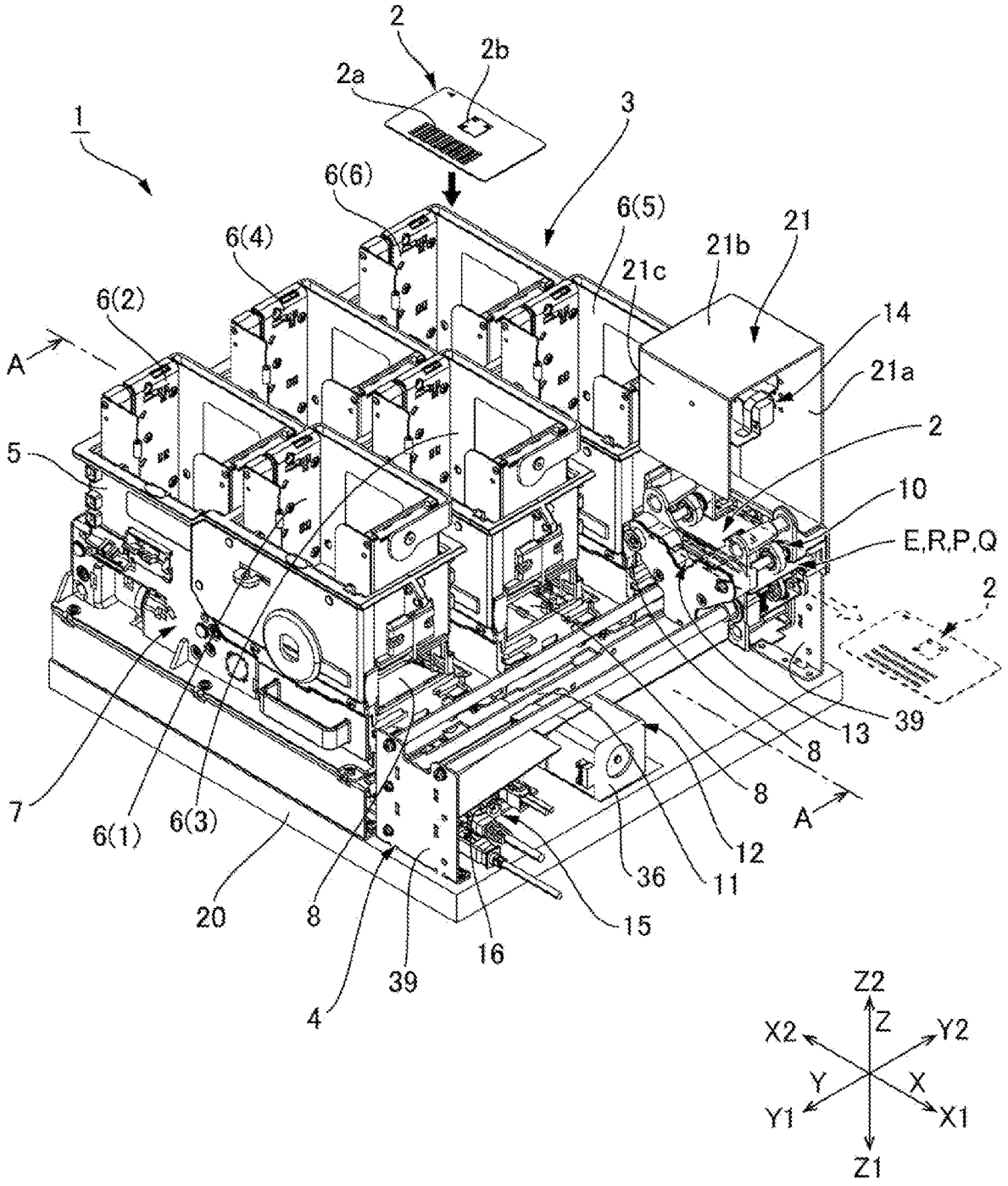
FIG. 1 is an outward perspective view showing a card issuing device.
Figure 2:
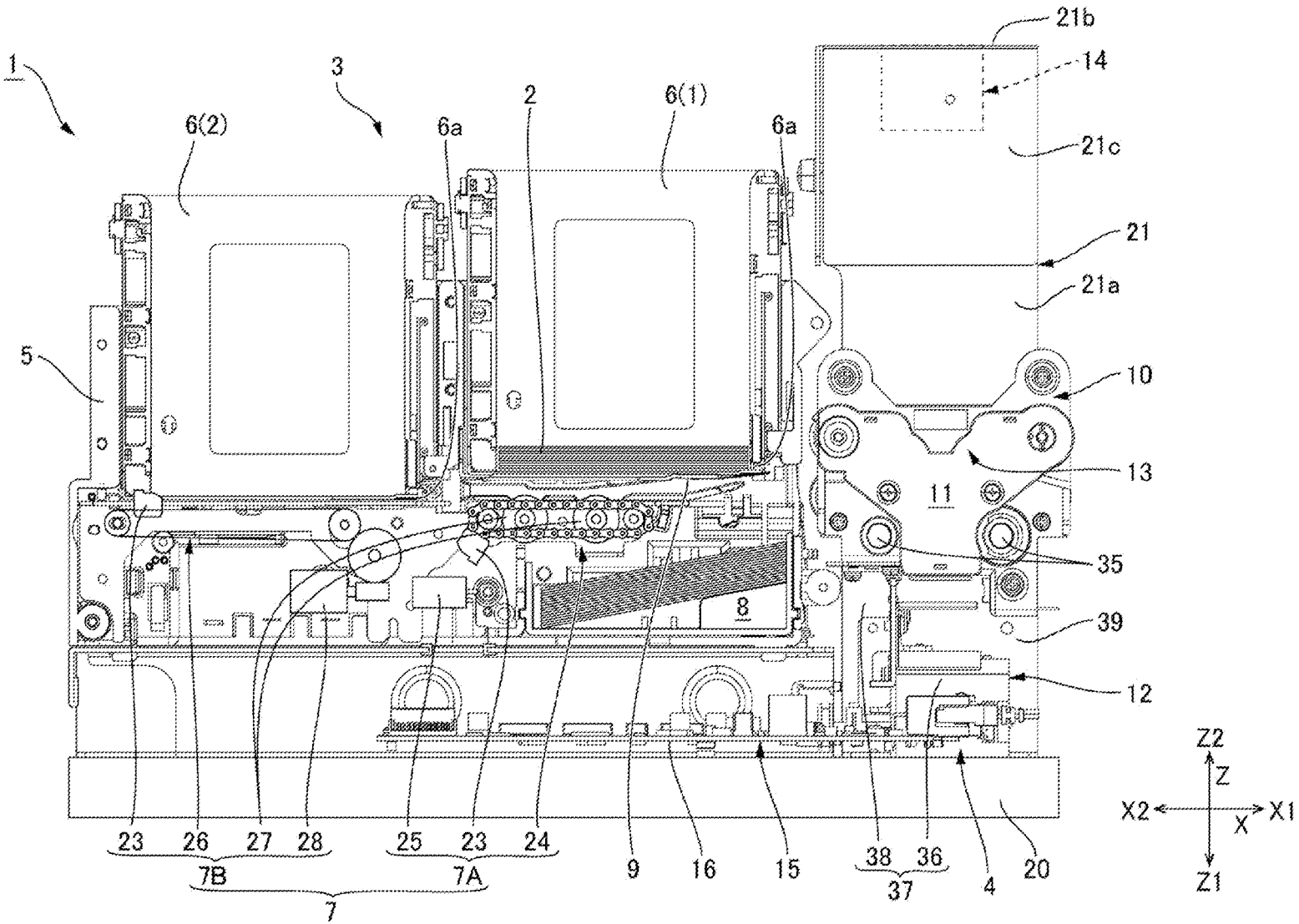
FIG. 2 is an "A-A" line cross-sectional view in FIG. 1.
Figure 3:
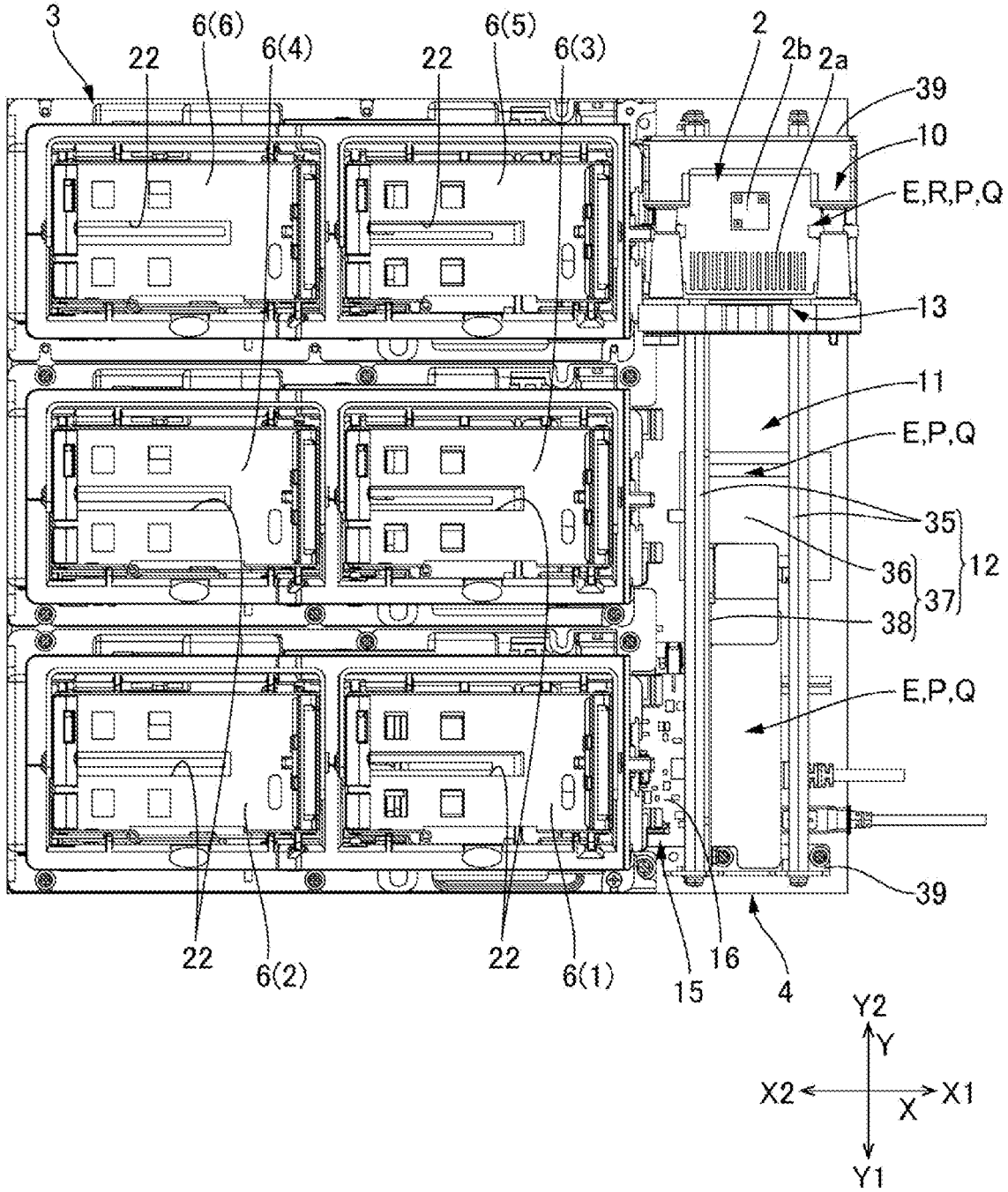
FIG. 3 is a plan view showing a card issuing device from which a code reader and a frame are detached.

FIG. 1 is an outward perspective view showing a card issuing device to which the present invention is applied. FIG. 2 is a cross-sectional view showing the card issuing device which is cut at the "A-A" position in FIG. 1. FIG. 3 is a plan view showing the card issuing device which is viewed from the "Z2" direction side. In FIG. 3, a code reader and a frame which supports the code reader are detached from the card issuing device. Further, in FIG. 3, a card issuing device does not store cards.

A card issuing device 1 (card conveyance unit) shown in FIG. 1 is communicably connected with a host apparatus not shown and used. The card issuing device 1 issues a card 2 as a member card whose front face is indicated (printed) with a bar code 2*a* (one dimensional code) and two dimensional code 2*b* based on a card issue instruction from the host apparatus. The two dimensional code 2*b* is, for example, a "QR" code (registered trademark).

As shown in FIGS. 1 and 2, the card issuing device 1 includes a card storage part 3 which stores cards 2 having not issued yet. Further, the card issuing device 1 includes a card conveyance mechanism 4 on the "X1" direction side with respect to the card storage part 3. The card storage part 3 and the card conveyance mechanism 4 are installed on a base 20 in a rectangular plate shape.

As shown in FIG. 1, the card storage part 3 includes a cassette holder 5 and a plurality of card cassettes 6 which are detachably attached to the cassette holder 5. A plurality of the card cassettes 6 is arranged in the "Y" direction. In this embodiment, the card storage part 3 includes six card cassettes 6(1) through 6(6). Six card cassettes 6(1) through 6(6) are arranged so that three rows each of which is comprised of two cassettes disposed in the "X" direction are arranged in the "Y" direction. Cards 2 are laminated and stored in each card cassette 6 in a posture that each face of a card 2 printed with a bar code 2*a* and two dimensional code 2*b* is directed to the "Z2" direction side.

Further, as shown in FIG. 2, the card storage part 3 includes a card send-out mechanism 7 structured to send out a card 2 one by one to the "X1" direction side from each of the card cassettes 6(1) through 6(6). In addition, the card storage part 3 includes card collection parts 8 which are respectively provided on the "Z1" direction side with respect to the card cassettes 6(1), 6(3) and 6(5) in the card cassettes 6 disposed in two rows in the "X" direction.

As shown in FIG. 3, the card conveyance mechanism 4 includes a carriage 10, a carriage conveyance passage 11 which is extended in the "Y" direction (arrangement direction of a plurality of the card cassettes 6) on the "X1" direction side with respect to the card storage part 3, and a carriage moving mechanism 12 structured to move the carriage 10 along the carriage conveyance passage 11. The carriage 10 includes a conveying mechanism 13 which is capable of conveying a card 2 in the "X" direction. The conveying mechanism 13 takes a card 2 which is sent out from the card cassette 6 and holds the card 2 in the carriage 10, and the conveying mechanism 13 sends out the card 2 from the carriage 10 to the "X1" direction side or to the "X2" direction side.

The carriage conveyance passage 11 is set with a plurality of taking-in positions "E" where a card 2 sent out from each of the card cassettes 6 is taken into the carriage 10 on one side in the "X" direction with respect to the respective card cassettes 6. Further, the carriage conveyance passage 11 is set with a reading position "R" where a bar code 2*a* on a card 2 held by the carriage 10 is read, a sending-out position "P" where a card 2 is sent out from the carriage 10 to one side in the "X" direction, and a collecting position "Q" where a card 2 is collected from the carriage 10. In this embodiment, the taking-in position "E" is set on the "X1" direction side with respect to each row comprising two card cassettes 6. Therefore, the taking-in position "E" is provided at three positions on the carriage conveyance passage 11. The reading position "R" and the sending-out position "P" are set at the same position as each other. In this embodiment, the reading position "R" and the sending-out position "P" are set in an end portion on the "Y2" direction side of the carriage conveyance passage 11. Further, the collecting position "Q" is set at the same position as the taking-in position "E". Therefore, the collecting position "Q" is set at three positions on the carriage conveyance passage 11 similarly to the taking-in position "E".

In this embodiment, as shown in FIG. 1, a code reader 14 is installed on the "Z2" direction side with respect to the reading position "R". The code reader 14 is fixed to a frame 21 which is attached to an end portion on the "Y2" direction side of the carriage moving mechanism 12. The frame 21 is provided with a first extended part 21*a* which is extended from the carriage moving mechanism 12 to the "Z2" direction side, a bent part 21*b* which is bent to the "Y1" direction side from an end on the "Z2" direction side of the first extended part 21*a* and is extended to the "Y1" direction side, and a second extended part 21*c* which is extended to the "Z1" direction side from an end on the "Y1" direction side of the bent part 21*b*. The code reader 14 is attached to the bent part 21*b* in a posture facing the "Z1" direction side.

The code reader 14 faces a card 2 on the carriage 10 in the "Z" direction at the reading position "R". The code reader 14 includes, for example, an image sensor and irradiates an illumination light toward a card 2 to acquire images of a bar code 2*a* and two-dimensional code 2*b* and then, image analysis is performed to acquire information of the codes. When the code reader 14 reads information from a card 2, the read information is transmitted to a host apparatus.

Further, a control part 15 is attached to the base 20 at a position overlapping with an end portion on the "Y1" direction side of the carriage conveyance passage 11. As shown in FIG. 2, the control part 15 includes a board 16 on which a circuit provided with a CPU, ROM, RAM and the like is mounted.

The control part 15 drives and controls the card send-out mechanism 7, the carriage moving mechanism 12, the conveying mechanism 13 and the code reader 14.

Further, after the control part 15 has driven the code reader 14, the control part 15 acquires a result whether the information that the code reader 14 has read has been transmitted to a host apparatus or not. More specifically, in a case that the information that the code reader 14 has read is transmitted to the host apparatus during a predetermined time period after the control part 15 drives the code reader 14, it is determined that a reading operation of the bar code 2*a* and the two-dimensional code 2*b* has been normally performed. Further, in a case that the information that the code reader 14 has read is not transmitted to the host apparatus during a predetermined time period after the control part 15 drives the code reader 14, it is determined that a reading operation of the bar code 2*a* and the two-dimensional code 2*b* has not been normally performed. In other words, the control part 15 acquires a result whether a reading operation of the code reader 14 has been normally performed or not by monitoring presence or absence of the transmission of information from the code reader 14.

(Card Issuing Operation)

Figure 4:
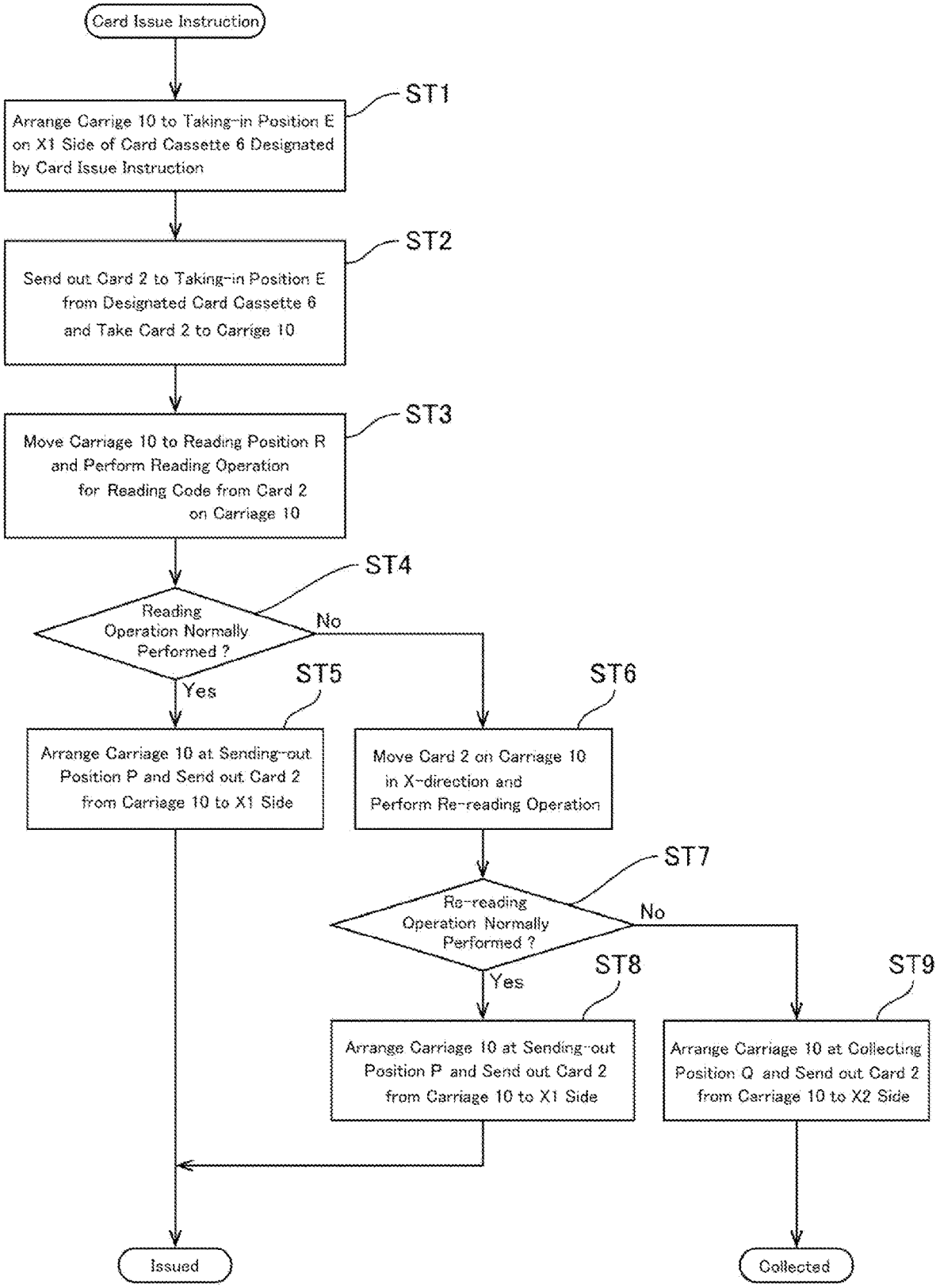
FIG. 4 is a flow chart showing a card issuing operation.

FIG. 4 is a flow chart showing a card issuing operation for issuing a card 2. When a card 2 is to be issued, a card issue instruction is transmitted from a host apparatus to the card issuing device 1. The card issue instruction is inputted into the control part 15. The card issue instruction includes designating information which designates one of the card cassettes 6 from which a card 2 having not issued yet is supplied.

As shown in FIG. 4, when a card issue instruction is inputted, the control part 15 drives the carriage moving mechanism 12 to arrange the carriage 10 to the taking-in position "E" located on the "X1" direction side with respect to the designated card cassette 6 (step "ST1"). Next, the control part 15 drives and controls the card send-out mechanism 7 to send out a card 2 from the designated card cassette 6 to the taking-in position "E". Simultaneously, the control part 15 drives and controls the conveying mechanism 13 of the carriage 10 to take the card 2 into the carriage 10 (step "ST2").

After that, the control part 15 drives and controls the carriage moving mechanism 12 to move the carriage 10 to the reading position "R" and then, the control part 15 drives and controls the code reader 14 to perform a reading operation in which a code (bar code 2*a* and two-dimensional code 2*b*) is read from the card 2 on the carriage 10 (step "ST3").

In this embodiment, in a case that information read by the code reader 14 is transmitted to the host apparatus, the control part 15 determines that reading of information from the card 2 has been normally performed (step "ST4": "Yes"). As a result, the control part 15 drives and controls the carriage moving mechanism 12 to arrange the carriage 10 at the sending-out position "P" and, after that, the control part 15 drives and controls the conveying mechanism 13 to send out the card 2 to the "X1" direction side from the carriage 10 (step "ST5"). In this manner, issue of a card 2 has been completed. In this embodiment, the reading position "R" and the sending-out position "P" are the same as each other. Therefore, when the reading operation is performed, the carriage 10 is arranged at the sending-out position "P". Accordingly, in this embodiment, the control part 15 does not drive the carriage moving mechanism 12 after the reading operation is performed, and the control part 15 drives the conveying mechanism 13 to send out the card 2 from the carriage 10 to the "X1" direction side.

On the other hand, in a case that information read by the code reader 14 is not transmitted to the host apparatus, and that the control part 15 determines that reading of information from a card 2 has not been performed normally (step "ST4": "No"), the control part 15 drives and controls the conveying mechanism 13 to move the card 2 in the "X" direction on the carriage 10. A moving direction and a moving amount of the card 2 which is moved on the carriage 10 by the control part 15 are previously set. After that, the control part 15 drives and controls the code reader 14 again to perform a re-reading operation (step "ST6").

In a case that reading of information from the card 2 has been normally performed by the re-reading operation (step "ST7": "Yes"), the control part 15 drives and controls the carriage moving mechanism 12 to arrange the carriage 10 at the sending-out position "P" and, after that, the control part 15 drives and controls the conveying mechanism 13 to send out the card 2 to the "X1" direction side from the carriage 10. In this embodiment, the reading position "R" and the sending-out position "P" are the same as each other. Therefore, when the reading operation is performed, the carriage 10 is arranged at the sending-out position "P". Accordingly, the control part 15 does not drive the carriage moving mechanism 12 after the reading operation has been performed, and the control part 15 drives the conveying mechanism 13 to send out the card 2 from the carriage 10 to the "X1" direction side (step "ST8"). As a result, issue of a card 2 has been completed.

In this embodiment, in a case that information read by the code reader 14 is not also transmitted to the host apparatus by the re-reading operation, and that the control part 15 determines that reading of information from the card 2 has not been normally performed (step "ST7": "No"), the control part 15 drives and controls the carriage moving mechanism 12 to arrange the carriage 10 at the collecting position "Q" and, after that, the control part 15 drives and controls the conveying mechanism 13 to send out the card 2 to the "X2" direction side from carriage 10 (step "ST9"). As a result, the card 2 is sent out from the carriage 10 toward the "X2" direction side and the card 2 is guided by the guide member 9 to be collected in the card collection part 8. In this embodiment, in a case that the card 2 is to be collected in the card collection part 8 located on the "Z1" direction side with respect to the card cassette 6(5), the reading position "R" and the collecting position "Q" are the same as each other. Therefore, when the reading operation has been performed, the carriage 10 is arranged at the collecting position "Q". Accordingly, in this embodiment, the control part 15 does not drive the carriage moving mechanism 12 after the reading operation has been performed, and the control part 15 drives the conveying mechanism 13 to send out the card 2 to the "X2" direction side from the carriage 10.

According to the card issuing device 1 in this embodiment, when a card 2 is to be issued as a member card or the like, a code (bar code 2*a* and two-dimensional code 2*b*) indicated (printed) on a surface of the card 2 is read and the read information is transmitted to the host apparatus. Therefore, in the host apparatus, the information of the code printed on the card 2 to be issued can be associated with information of a member who is an owner of the card 2.

(Details of Card Storage Part)

Next, details of the card storage part 3 will be described below with reference to FIGS. 1 through 3. As shown in FIGS. 1 through 3, the card cassette 6 is formed in a rectangular tube shape having a bottom and is, as a whole, formed in a rectangular parallelepiped shape. As shown in FIG. 2, an end portion on the "Z1" direction side of each card cassette 6 is provided with an opening part 6*a* facing the "X1" direction side when the card cassette 6 is attached to the cassette holder 5. The opening part 6*a* is provided with a shape which allows one card 2 to pass through in the "X" direction.

The card send-out mechanism 7 includes a first card send-out mechanism 7A structured to send out a card 2 stored in the card cassette 6(1), 6(3) or 6(5) located on the "X1" direction side of two card cassettes 6 arranged in the "X" direction to the "X1" direction side. Further, the card send-out mechanism 7 includes, in the card storage part 3, a second card send-out mechanism 7B structured to send out a card 2 stored in the card cassette 6(2), 6(4) or 6(6) located on the "X2" direction side of two card cassettes 6 arranged in the "X" direction to the "X1" direction side.

The first card send-out mechanism 7A is provided in each end portion on the "Z1" direction side of the card cassettes 6(1), 6(3) and 6(5). The first card send-out mechanism 7A includes a slit 22 (see FIG. 3) which is provided in a bottom face of the card cassette 6 so as to be extended in the "X" direction, and a card sending-out claw 23 (see FIG. 2) which is capable of protruding in the slit 22. The card sending-out claw 23 is capable of engaging with an edge of a card 2 located at the lowest position of cards 2 stored in the card cassette 6 from the "X2" direction side. Further, the first card send-out mechanism 7A includes, as shown in FIG. 2, a chain drive mechanism 24 for moving the card sending-out claw 23 in the "X" direction, and a motor 25 for driving the chain drive mechanism 24. The card sending-out claw 23 of the first card send-out mechanism 7A is fixed to a chain of the chain drive mechanism 24.

When a card 2 is to be sent out to the "X1" side from the card cassettes 6(1), 6(3) and 6(5), the control part 15 drives the first card send-out mechanism 7A. In other words, the control part 15 drives the motor 25 to operate the chain drive mechanism 24, and the card sending-out claw 23 is protruded in the slit 22 and moved to the "X1" direction side. As a result, the card sending-out claw 23 is engaged with a card 2 located at the lowest position of the cards 2 laminated in the card cassette 6 to send out the card 2 to the taking-in position "E" of the carriage conveyance passage 11.

The second card send-out mechanism 7B includes, similarly to the first card send-out mechanism 7A, a slit 22 which is provided in a bottom face of the card cassette 6 and is extended in the "X" direction and a card sending-out claw 23 which is capable of being arranged in the slit 22. Further, the second card send-out mechanism 7B includes a belt mechanism 26 which is provided in each of end portions on the "Z1" direction side of the card cassettes 6(2), 6(4) and 6(6), a plurality of sending-out rollers 27 provided on the "Z1" direction side with respect to the card cassettes 6(1), 6(3) and 6(5), and a motor 28 for driving the belt mechanism 26 and a plurality of the sending-out rollers 27. A plurality of the sending-out rollers 27 is disposed in the "Y" direction with respect to the chain drive mechanism 24 of the first card send-out mechanism 7A.

When a card 2 is to be sent out to the "X1" side from the card cassettes 6(2), 6(4) and 6(6), the control part 15 drives the second card send-out mechanism 7B. In other words, the control part 15 drives the motor 28 to operate the belt mechanism 26 so that the card sending-out claw 23 is protruded in the slit 22 and is moved to the "X1" direction side. Further, the control part 15 rotates the sending-out rollers 27. As a result, the card sending-out claw 23 is engaged with a card 2 located at the lowest position of cards 2 which are laminated in the card cassette 6, and the card 2 is moved to the "X1" direction side and is transferred to the sending-out rollers 27. The sending-out rollers 27 further convey the transferred card 2 to the "X1" direction side and send out to the taking-in position "E" of the carriage conveyance passage 11. In this embodiment, when a card 2 is to be sent out to the "X1" side from the card cassettes 6(2), 6(4) and 6(6), the card sending-out claw 23 of the first card send-out mechanism 7A has been moved to the "Z1" direction side of the chain drive mechanism 24.

In this embodiment, the card collection part 8 is provided on the "Z1" direction side with respect to the card cassettes 6(1), 6(3) and 6(5) which are located on the "X1" side in the card storage part 3. A guide member 9 is disposed between the card collection part 8 and the card cassette 6. The guide member 9 is a plate spring which is inclined to the "Z2" direction side as going toward the "X1" direction side. A card 2 sent out to the "X1" direction side from each card cassette 6 by the card send-out mechanism 7 is guided by the guide member 9 to the carriage 10 which is arranged at the taking-in position "E". On the other hand, a card 2 to be returned to the "X2" direction side from the carriage 10 located at the collecting position "Q" is guided to the "Z1" direction side by the guide member 9 and is stored in the card collection part 8.

(Details of Carriage Moving Mechanism)

As shown in FIGS. 2 and 3, the carriage moving mechanism 12 includes two guide shafts 35 which are extended in parallel with each other in the "Y" direction along the carriage conveyance passage 11, and a belt mechanism 37 which moves the carriage 10 along the guide shafts 35. The belt mechanism 37 includes a carriage motor 36 as a drive source. The two guide shafts 35 are supported by a pair of support frames 39 which are extended to the "Z2" direction side from the base 20 at both ends in the "Y" direction of the carriage conveyance passage 11. The carriage 10 is fixed to a carriage belt 38 of the belt mechanism 37. When the carriage 10 is to be moved along the carriage conveyance passage 11, the control part 15 drives and controls the carriage motor 36. In this embodiment, the frame 21 to which the code reader 14 is attached is fixed to the support frame 39 located on the "Y2" direction side.

(Details of Carriage)

Figure 5:
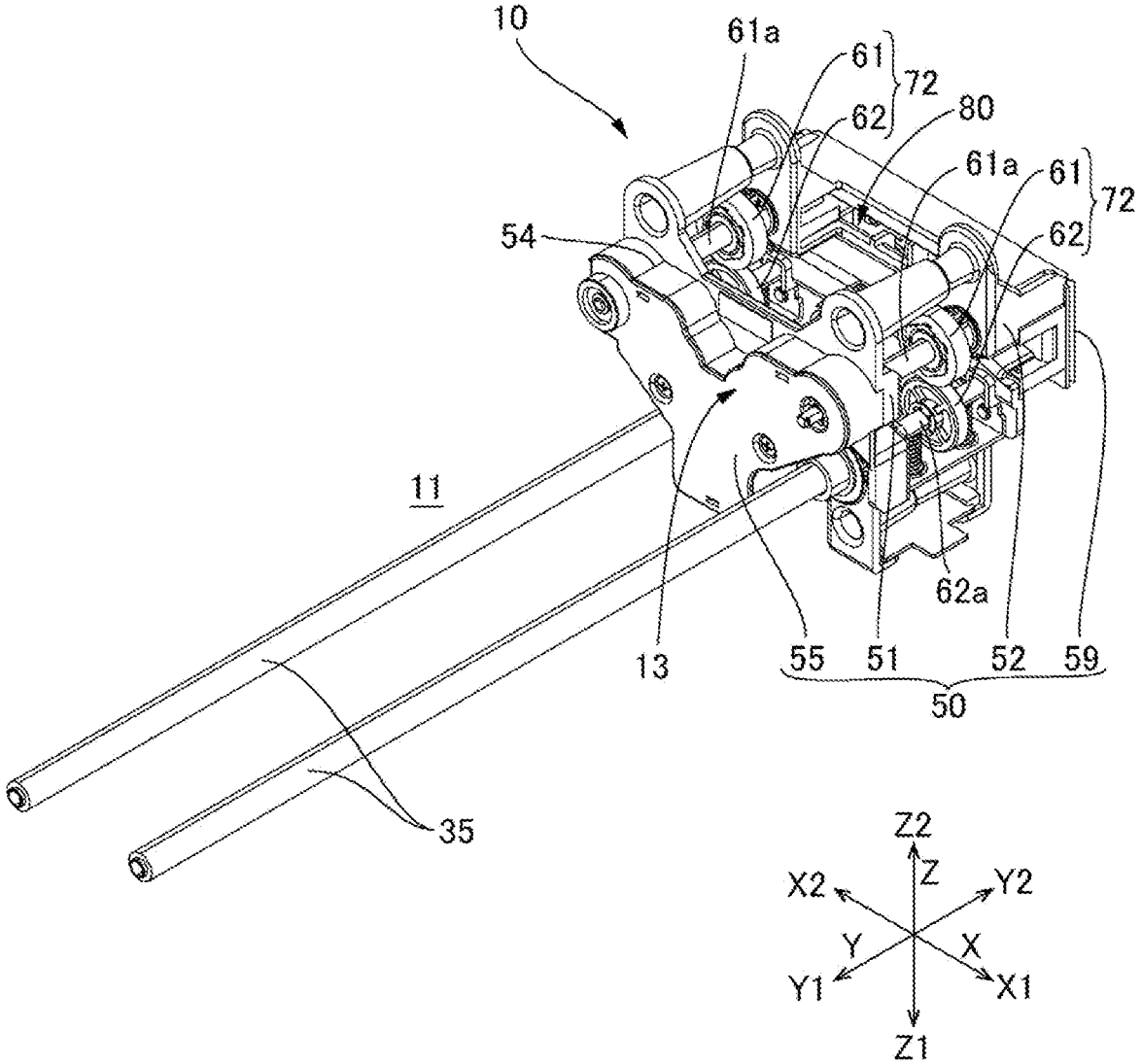
FIG. 5 is a perspective view showing guide shafts and a carriage.
Figure 6:
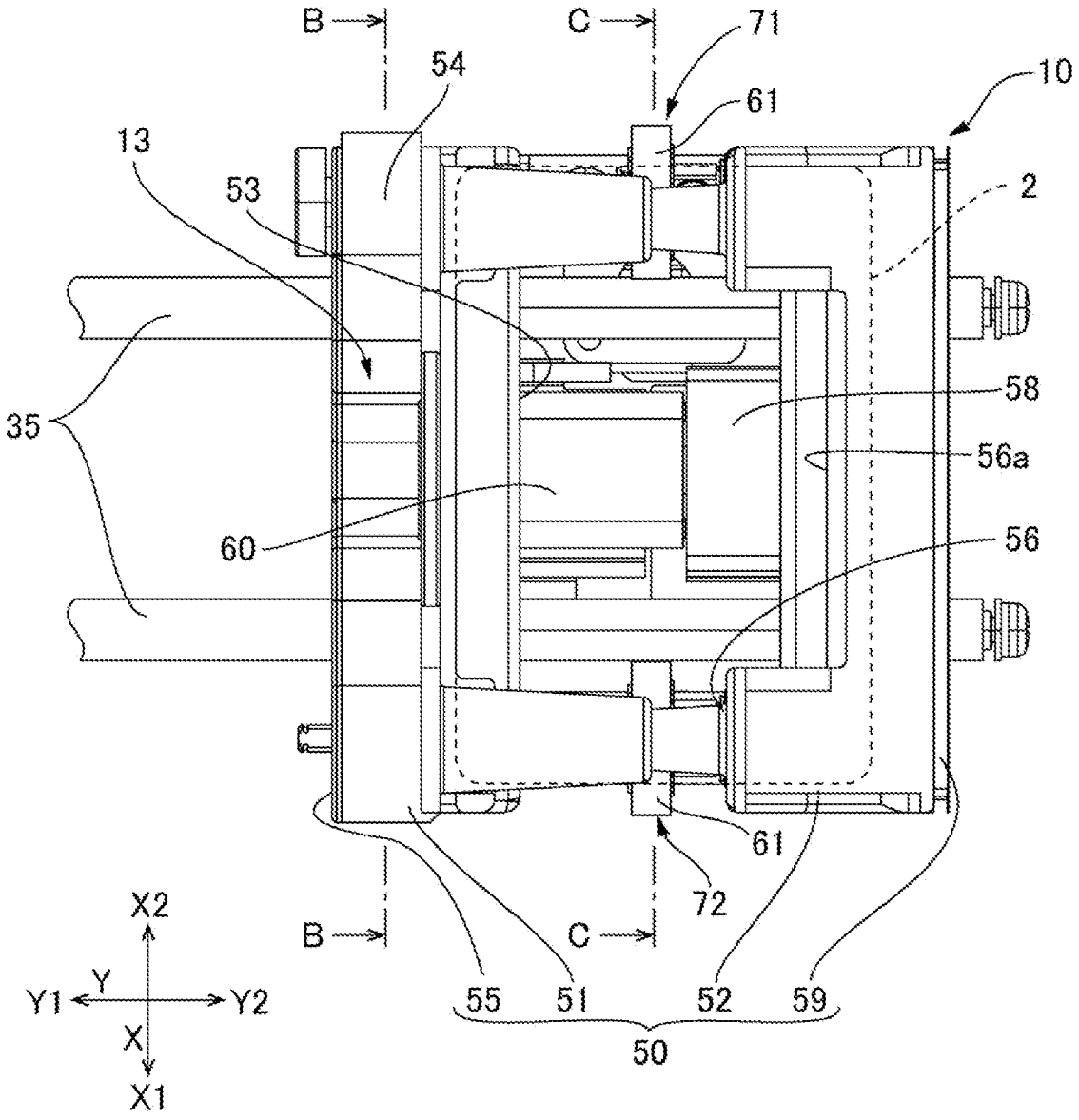
FIG. 6 is a plan view showing a carriage.
Figure 7:
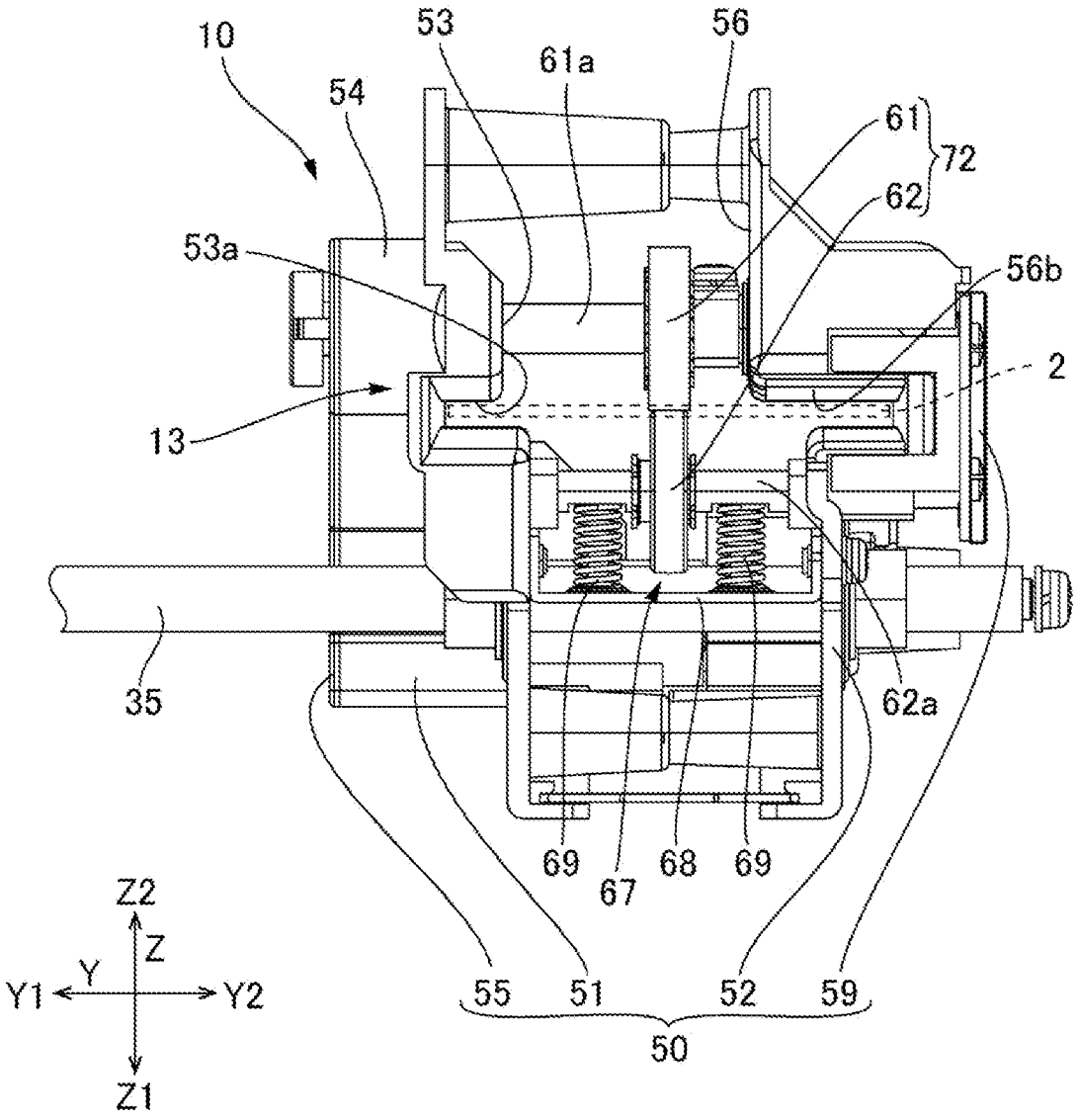
FIG. 7 is a front view showing a carriage.
Figure 8:
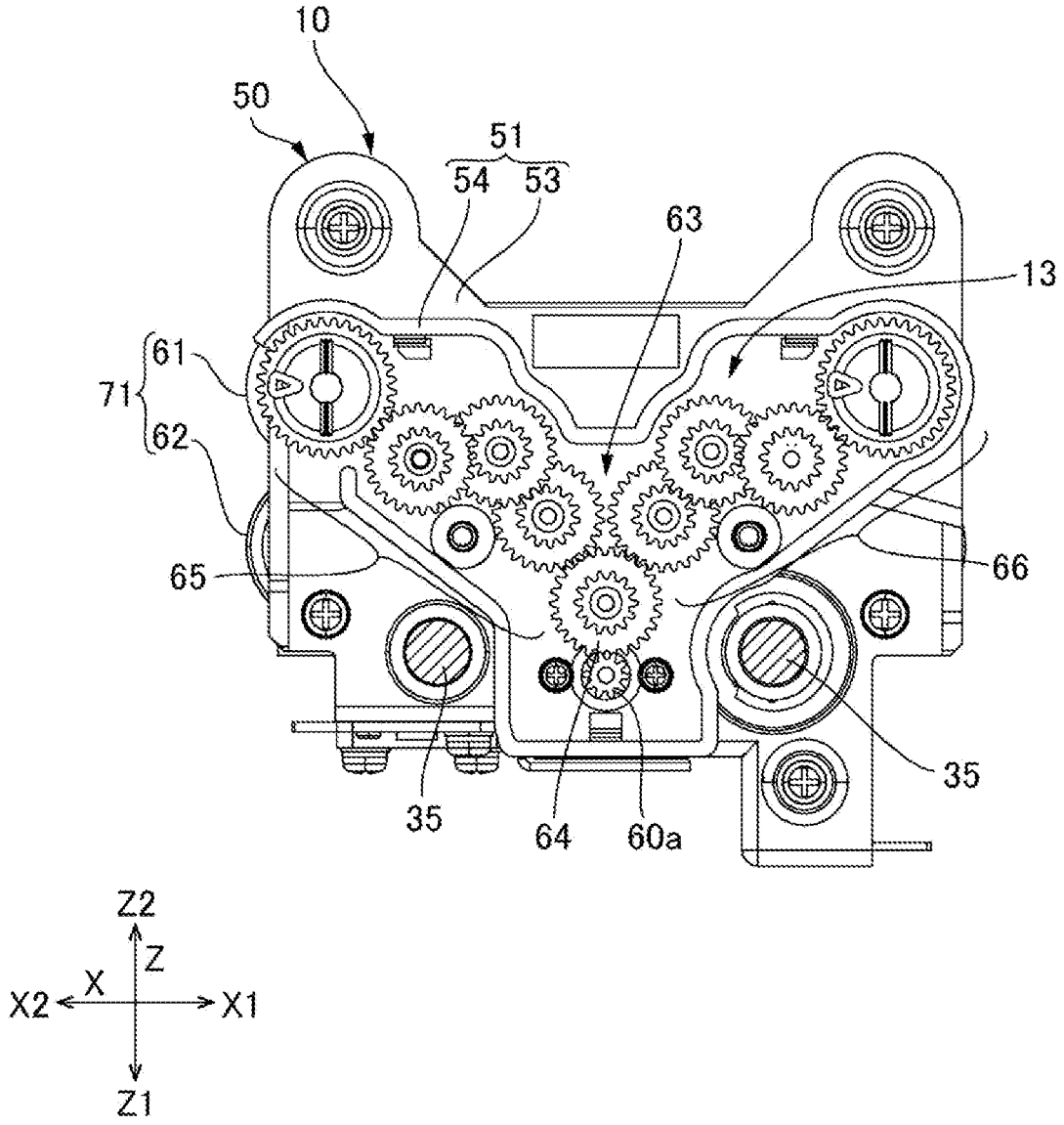
FIG. 8 is a "B-B" line cross-sectional view showing a carriage in FIG. 6.
Figure 9:
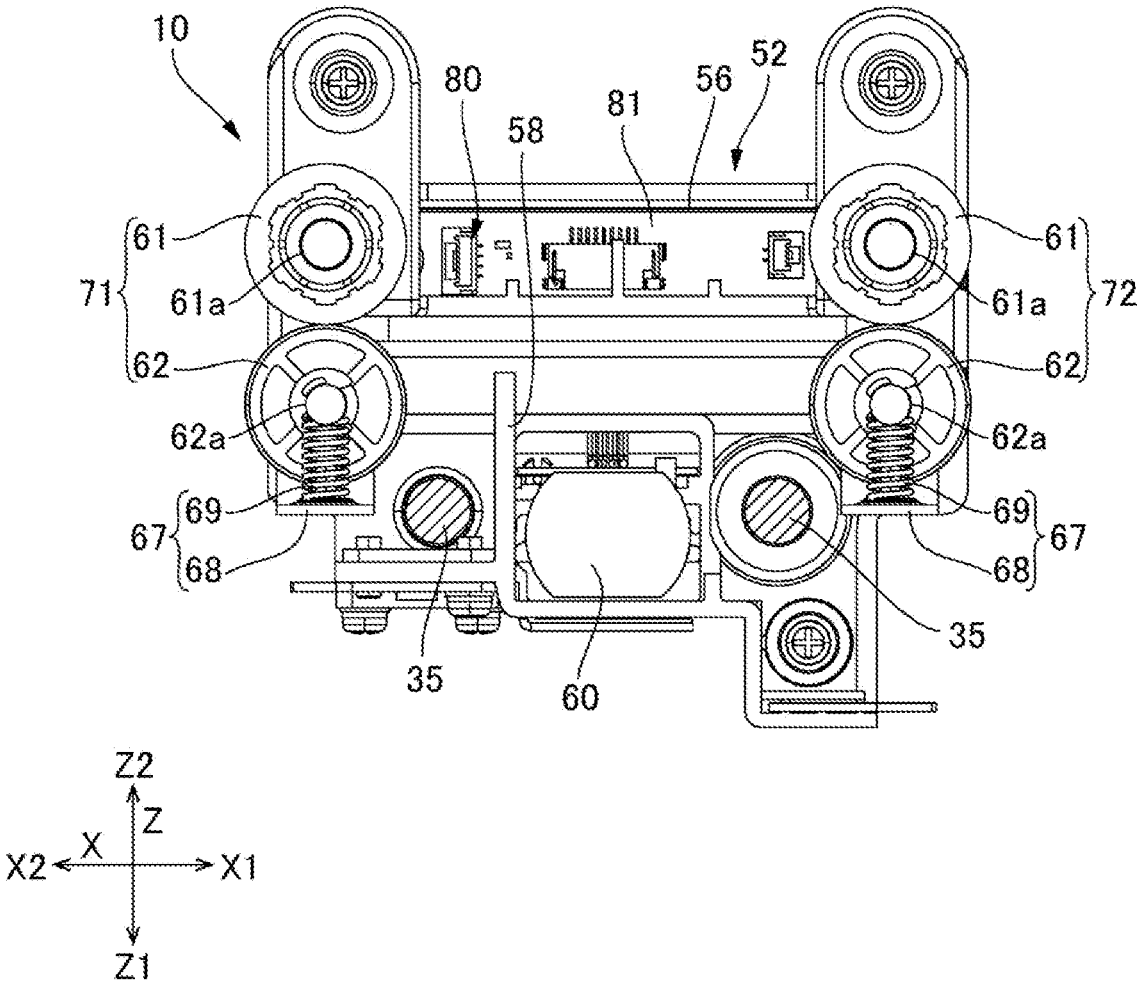
FIG. 9 is a "C-C" line cross-sectional view showing a carriage in FIG. 6.
Figure 10:
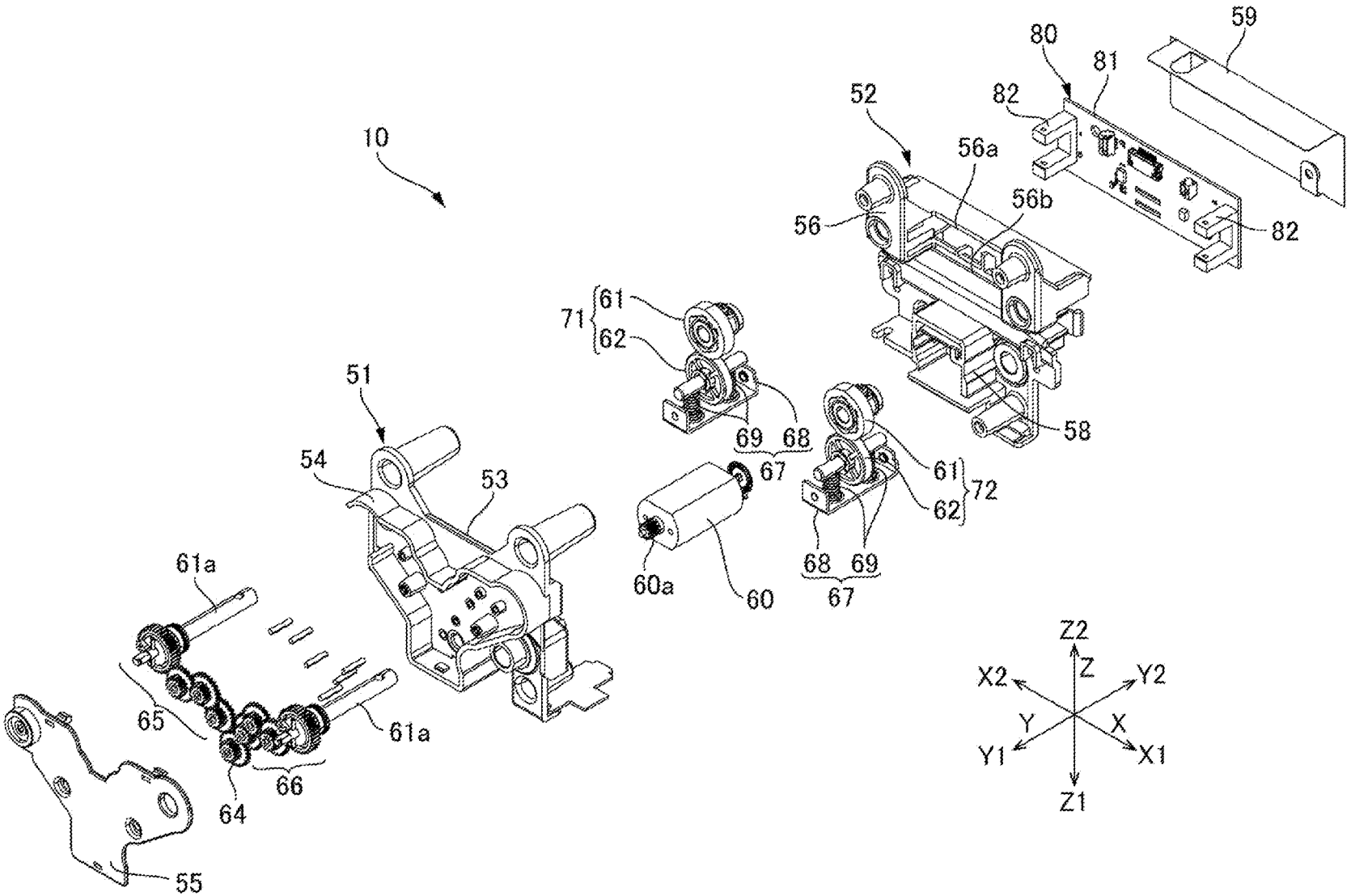
FIG. 10 is an exploded perspective view showing a carriage.

FIG. 5 is a perspective view showing the carriage 10 and the guide shafts 35. FIG. 6 is a plan view showing the carriage 10 which is viewed from the "Z2" direction side. FIG. 7 is a front view showing the carriage 10 which is viewed from the "X1" direction side. FIG. 8 is the "B-B" line cross-sectional view in FIG. 6. FIG. 9 is the "C-C" line cross-sectional view in FIG. 6. FIG. 10 is an exploded perspective view showing the carriage 10.

As shown in FIG. 5, the carriage 10 includes a carriage frame 50 made of resin. As shown in FIG. 6, the conveying mechanism 13 provided in the carriage 10 includes a motor 60 (see FIG. 9) which is fixed to the carriage frame 50, a first roller pair 71 and a second roller pair 72 (see FIG. 5) each of which has a drive roller 61 and a driven roller 62, and a gear train 73 (see FIG. 8) which transmits rotation of the motor 60 to the drive rollers 61 of the respective roller pairs 71 and 72.

The first roller pair 71 and the second roller pair 72 are located at a center in the "Y" direction of the carriage 10. Further, the first roller pair 71 is disposed at an end part on the "X2" direction side of the carriage frame 50, and the second roller pair 72 is disposed at an end part on the "X1" direction side of the carriage frame 50. In each of the roller pairs 71 and 72, the drive roller 61 is located on the "Z2" direction side with respect to the driven roller 62. The drive roller 61 includes a first rotation shaft 61*a* which is extended in the "Y" direction from its center. The driven roller 62 includes a second rotation shaft 62*a* which is extended in the "Y" direction from its center. The drive roller 61 and the driven roller 62 are rotatably supported by the carriage frame 50.

The carriage frame 50 includes a first frame 51 located on the Y1" direction side with respect to the first roller pair 71 and the second roller pair 72, and a second frame 52 disposed on the "Y2" direction side with respect to the first roller pair 71 and the second roller pair 72. As shown in FIGS. 6 and 7, the first frame 51 is provided with a side plate part 53 facing the drive rollers 61 and the driven rollers 62 from the "Y1" direction side, and a protruded wall 54 which is protruded from the side plate part 53 to the "Y1" direction side so as to surround a periphery of the gear train 73. Further, the carriage frame 50 includes a first cover 55 made of resin which is abutted with an end on the "Y1" direction side of the protruded wall 54 and is fixed to the first frame 51. The gear train 73 is accommodated between the first cover 55 and the first frame 51. As shown in FIG. 7, the side plate part 53 of the first frame 51 is provided with a first guide groove 53*a* which is recessed to the "Y1" direction side.

The second frame 52 is provided with a side plate part 56 which faces the side plate part 53 of the first frame 51 in the "Y" direction. As shown in FIG. 6, the side plate part 56 is provided with a recessed part 56*a* which is recessed to the "Y2" direction side in a center portion in the "X" direction. Further, as shown in FIG. 7, the side plate part 56 is provided with a second guide groove 56*b* which is recessed to the "Y2" direction side at a position facing the first guide groove 53*a*. In addition, the second frame 52 is, as shown in FIGS. 6 and 10, provided with a motor holding part 58 which is protruded from the side plate part 56 to the "Y1" direction side on the "Z1" direction side with respect to the second guide groove 56*b*. The motor 60 is held by the motor holding part 58 and is located on the "Z1" direction side with respect to the first guide groove 55*a* and the second guide groove 56*b*.

As shown in FIG. 7, a pressing mechanism 67 which presses the driven roller 62 toward the drive roller 61 is disposed between the first frame 51 and the second frame 52. The pressing mechanism 67 includes a pressing spring support member 68 extended in the "Y" direction on the "Z1" direction side with respect to the second rotation shaft 62*a*, and pressing springs 69 which are disposed in a compressed state between the second rotation shaft 62*a* and the pressing spring support member 68 on both sides in the "Y" direction with respect to the driven roller 62. An end part on the "Y2" side of the pressing spring support member 68 is fixed to the second frame 52, and an end part on the "Y1" direction side of the pressing spring support member 68 is fixed to the first frame 51.

As shown in FIG. 8, the gear train 73 includes a first gear 64 engaged with a pinion 60*a* which is provided in an output shaft of the motor 60, a first gear train 65 comprised of a plurality of gears disposed on the "X2" direction with respect to the first gear 64, and a second gear train 66 comprised of a plurality of gears disposed on the "X1" side with respect to the first gear 64. The first gear train 65 and the second gear train 66 are symmetrically structured in the "X" direction with a rotation center of the first gear 64 as a reference. The first gear train 65 transmits rotation of the motor 60 to the first rotation shaft 61*a* of the drive roller 61 of the first roller pair 71 which is rotatably supported at an end part on the "X2" direction side of the first frame 51. The second gear train 66 transmits rotation of the motor 60 to the first rotation shaft 61*a* of the drive roller 61 of the second roller pair 72 which is rotatably supported at an end part on the "X1" direction side of the first frame 51. Therefore, the drive rollers 61 and the driven rollers 62 of the roller pairs 71 and 72 are rotated in a synchronous manner.

In this embodiment, ss shown in FIGS. 5, 9 and 10, the carriage 10 includes a card detection part 80. The card detection part 80 includes a sensor board 81 fixed to the second frame 52 from the "Y1" side and photo sensors 82 which are disposed on the sensor board 81. The carriage frame 50 includes a second cover 59 made of resin which covers the sensor board 81 from the "Y2" direction side. The second cover 59 is fixed to the second frame 52 together with the sensor board 81.

The photo sensors 82 are disposed one by one at both ends in the "X" direction of the sensor board 81. The card detection part 80 detects a card 2 based on a signal of the photo sensor 82 located at an end on the "X2" direction side when the card 2 is taken into the carriage 10. Further, the card detection part 80 detects a card 2 based on a signal of the photo sensor 82 located at an end on the "X1" direction side when the card 2 is sent out from the carriage 10. The sensor board 81 is provided with a sensor circuit which determines a passage of a card 2 based on a signal from the photo sensor 82. An output from the card detection part 80 (sensor circuit) is inputted into the control part 15.

(Operation of Conveying Mechanism)

When a card 2 sent out by the card send-out mechanism 7 toward a taking-in position "E" of the carriage conveyance passage 11 is to be taken into the carriage 10, both ends in the "Y" direction of the card 2 is guided by the first guide groove 53*a* and the second guide groove 56*b*. As a result, a center portion in the "Y" direction of the card 2 is capable of being held by the drive roller 61 and the driven roller 62 of the first roller pair 71. In this embodiment, the control part 15 drives the motor 60 of the conveying mechanism 13 to drive the respective drive rollers 61 of the roller pairs 71 and 72. As a result, the card 2 is taken into the carriage 10 in a state that the card 2 is sandwiched between the drive roller 61 and the driven roller 62 of the first roller pair 71 in the "Z" direction. After that, the card 2 is conveyed to the "X1" direction side by the first roller pair 71 and is stopped in a state that both end portions in the "X" direction of the card 2 are sandwiched by the first roller pair 71 and the second roller pair 72. As a result, the card 2 is held by the carriage 10.

Next, in a case that the control part 15 determines that a reading operation by the code reader 14 has been normally performed, the control part 15 drives the motor 60 to rotate the drive rollers 61 of the respective roller pairs 71 and 72 in a normal direction, and the card 2 is sent out from the carriage 10 to the "X1" direction side.

On the other hand, in a case that the control part 15 determines that the reading operation by the code reader 14 has not been normally performed, the control part 15 drives the motor 60 to rotate the drive rollers 61 of the respective roller pairs 71 and 72 in a normal direction or a reverse direction, and the card 2 is moved on the carriage 10 only by a predetermined amount to a predetermined side in the "X" direction. After that, the control part 15 drives the code reader 14 to perform a re-reading operation.

In this embodiment, in a case that the re-reading operation has not been normally performed, the control part 15 drives the motor 60 in a reverse direction to rotate the drive rollers 61 of the respective roller pairs 71 and 72 in a reverse direction, and the card 2 is sent out from the carriage 10 to the "X2" direction side.

(Operations and Effects)

In the card conveyance unit in this embodiment, the code reader 14 faces a card 2 which is held by the carriage 10 in the "Z" direction at the reading position "R" set in the carriage conveyance passage 11 and a code (bar code 2*a* and two-dimensional code 2*b*) is read. Therefore, the card cassette 6, the carriage conveyance passage 11 and the code reader 14 are avoided being arranged in this order in the "X" direction perpendicular to an arrangement direction of a plurality of the card cassettes 6. Accordingly, the card conveyance unit is prevented or restrained from being enlarged in the "X" direction. Further, in a structure that the card cassette 6, the carriage conveyance passage 11 and the code reader 14 are arranged in this order in the "X" direction, another send-out mechanism is required for further sending out a card 2 on which a reading operation has been performed by the code reader 14 to the "X1" direction side. However, when the reading position "R" by the code reader 14 is provided on the carriage conveyance passage 11, the card 2 having finished a reading operation by the code reader 14 can be sent out to the "X1" direction side by the conveying mechanism 13 provided in the carriage 10.

In this embodiment, the control part 15 acquires a result whether the code reader 14 has read a code in a reading operation or not and, in a case that the code has not been read, the control part 15 drives and controls the conveying mechanism 13 to move the card 2 on the carriage 10 in the "X" direction and perform a reading operation again. In other words, in a case that the code reader 14 is unable to read a code in the reading operation, a card 2 taken into the carriage 10 may be set in a state that the card 2 is not located at an appropriate position on the carriage 10. In this embodiment, the conveying mechanism 13 is capable of moving the card 2 in the "X" direction on the carriage 10. Therefore, in a case that the code reader 14 is unable to read a code, when the conveying mechanism 13 is driven and controlled to move the card 2 on the carriage 10, the code may be read by the code reader 14.

In this embodiment, the reading position "R" and the sending-out position "P" are the same as each other. Therefore, after the reading operation is finished, the card 2 can be sent out to the "X1" direction side without moving the carriage 10.

In this embodiment, one taking-in position "E" among a plurality of the taking-in positions "E", the reading position "R" and the sending-out position "P" are the same as each other. Therefore, when a card 2 is to be sent out from the card cassette 6(5) and the card cassette 6(6) located on the other side in the "X" direction with respect to the taking-in position "E", which is set at the same position as the reading position "R" and the sending-out position "P", reading of a code and sending-out to the "X1" direction side of the card 2 can be performed without moving the carriage 10 from the taking-in position "E".

In this embodiment, the collecting position "Q" where a card 2 is collected from the carriage 10 is set in the carriage conveyance passage 11. The control part 15 acquires a result whether the code reader 14 has read a code in a reading operation or not and, when the code has not been read, the control part 15 drives and controls the carriage moving mechanism 12 to arrange the carriage 10 at the collecting position "Q" and drives and controls the conveying mechanism 13 to send out the card 2 to the other side in the "X" direction from the carriage 10. Therefore, a card 2 which is unable to read a code by the code reader 14 can be ejected to the other side in the "X" direction from the carriage 10 and collected.

OTHER EMBODIMENTS

The reading position "R" and the sending-out position "P" can be set at an arbitrary position on the carriage conveyance passage 11. Further, the reading position "R" and the sending-out position "P" may be different from each other.

Further, in the embodiment described above, the card collection part 8 is provided on the "Z1" direction side of the card cassettes 6(1), 6(3) and 6(5). However, the card collection part 8 may be provided at only one position. In this case, the collecting position "Q" is set at one position located on the "X1" direction side with respect to the card collection part 8.

In accordance with an embodiment of the present invention, a front face of a card 2 may be printed with only one of a bar code 2*a* and two-dimensional code 2*b*. In a case that only a bar code 2*a* is printed on a card 2, a bar code reader may be adopted as the code reader 14 which irradiates reading light to the card 2 to read information based on the reflected light.

In accordance with an embodiment of the present invention, in a case that, as a card 2 on which a code is provided, a magnetic card having an information recording part such as a magnetic stripe is to be issued, or an IC card having an IC chip is to be issued, the card issuing device 1 in this embodiment is used as a card conveyance unit in which a card 2 is conveyed from the card storage part 3 to the "X1" direction side. Further, a card processing device for performing reading and writing of magnetic information to a magnetic stripe and reading and writing of information to an IC chip is installed on the "X1" direction side with respect to the sending-out position "P" of the card issuing device 1 and thereby, a card issuing device is structured. In this case, the card processing device takes a card 2 which is sent out from the carriage 10 to the "X1" direction side and performs reading and writing processing of information on the card and then, the card is issued.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A card conveyance unit comprising:

in a case that three directions perpendicular to each other are defined as an "X" direction, a "Y" direction and a "Z" direction, a plurality of card cassettes which are arranged in the "Y" direction;

a carriage;

a carriage conveyance passage which is extended in the "Y" direction on one side of the "X" direction with respect to the plurality of the card cassettes;

a carriage moving mechanism which moves the carriage along the carriage conveyance passage;

a card send-out mechanism which sends out cards laminated and stored in each of the card cassettes one by one to the one side in the "X" direction toward the carriage conveyance passage;

a conveying mechanism which is provided in the carriage to take in and hold the card sent out from the card cassette on the carriage and send out the card in the "X" direction from the carriage;

a code reader which optically reads a code indicated on a surface of the card and is not disposed at a location which is in alignment with the plurality of card cassettes and the carriage conveyance passage along the X direction and is disposed at the location displaced from the alignment toward the Y or the Z direction; and a control part which drives and controls the card send-out mechanism, the carriage moving mechanism, the conveying mechanism and the code reader;

wherein the carriage conveyance passage is set with:

a plurality of taking-in positions on the one side in the "X" direction with respect to the card cassettes where the card sent out from each of the card cassettes is taken into the carriage;

a reading position where the code of the card held by the carriage is optically read; and a sending-out position where the card is sent out from the carriage to the one side in the "X" direction;

one of the plurality of the taking-in positions, the reading position and the sending-out position are previously set at a same position as each other;

the code reader is fixed to a frame physically separated from the carriage so as to face the card which is held by the carriage in the "Z" direction at the reading position;

the control part is configured so that:

in a case that the taking-in position and the reading position are different from each other, the control part drives and controls the carriage moving mechanism to arrange the carriage at one of the plurality of the taking-in positions and then, the control part drives and controls the card send-out mechanism and the conveying mechanism to take the card into the carriage from the card cassette disposed on an other side in the "X" direction with respect to the carriage;

next, the control part drives and controls the carriage moving mechanism to move the carriage to the reading position, and the control part drives and controls the code reader to perform a reading operation for reading the code;

on the other hand, in a case that the taking-in position and the reading position are the same position as each other, the control part drives and controls the card send-out mechanism and the conveying mechanism at the reading position to take the card into the carriage from the card cassette disposed on an other side in the "X" direction with respect to the carriage, and the control part drives and controls the code reader to perform a reading operation for reading the code; and after that, the control part drives and controls the conveying mechanism to send out the card from the reading position to the one side in the "X" direction.

2. The card conveyance unit according to claim 1, wherein the control part acquires a result whether reading of the code has been normally performed by the reading operation or not, in a case that the code has not been read, the control part drives and controls the conveying mechanism to move a position of the card in the "X" direction on the carriage with respect to the code reader which is fixed to the frame and perform the reading operation again.

3. The card conveyance unit according to claim 1, wherein the code is one-dimensional code or two-dimensional code.

4. The card conveyance unit according to claim 1, wherein the carriage conveyance passage is set with a collecting position for collecting the card from the carriage, the control part acquires a result whether the code reader has read the code by the reading operation or not, and in a case that the code has not been read, control part drives and controls the conveying mechanism to send out the card to the collecting position on the other side in the "X" direction from the carriage.

* * * * *